US011767723B2

(12) United States Patent
Parkin et al.

(10) Patent No.: US 11,767,723 B2
(45) Date of Patent: Sep. 26, 2023

(54) DOWNHOLE TRANSDUCER ASSEMBLIES AND PRESSURE RANGE CONTROL THEREIN

(71) Applicant: Schlumberger Technology Corporation, Sugar Land, TX (US)

(72) Inventors: Edward George Parkin, Stonehouse (GB); Scott Richard Woolston, Spanish Fork, UT (US); Jonathan D. Marshall, Springville, UT (US); David C. Hoyle, Salt Lake City, UT (US); Jim Shumway, Provo, UT (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 17/503,315

(22) Filed: Oct. 17, 2021

(65) Prior Publication Data

US 2022/0034179 A1 Feb. 3, 2022

Related U.S. Application Data

(63) Continuation of application No. 16/639,613, filed as application No. PCT/US2018/047025 on Aug. 20, 2018, now Pat. No. 11,255,143.

(60) Provisional application No. 62/551,804, filed on Aug. 30, 2017.

(51) Int. Cl.
*E21B 21/08* (2006.01)
*E21B 41/00* (2006.01)

(52) U.S. Cl.
CPC ..... *E21B 21/08* (2013.01); *E21B 41/0078* (2013.01); *E21B 41/0085* (2013.01)

(58) Field of Classification Search
CPC .. E21B 21/08; E21B 41/0078; E21B 41/0085; E21B 17/16
See application file for complete search history.

(56) References Cited

U.S. PATENT DOCUMENTS 4,361,193 A * 11/1982 Gravley ..... E21B 7/04 175/320
5,839,508 A 11/1998 Tubel et al.
9,234,404 B2 1/2016 Felton
2006/0113803 A1 6/2006 Hall et al.
(Continued)

FOREIGN PATENT DOCUMENTS

WO 2016055316 A1 4/2016

OTHER PUBLICATIONS

First Examination Report in Saudi Arabia Patent Application No. 520411420, dated Jun. 3, 2022, 9 pages.
(Continued)

*Primary Examiner* — Brad Harcourt
(74) *Attorney, Agent, or Firm* — Jeffrey D. Frantz

(57) ABSTRACT

A downhole transducer assembly capable of being safely operated at a variety of pressures and depths may include a turbine rotatable by a fluid pressure differential rotationally fixed to a rotor in a generator. To reduce the rotational speed of the turbine and rotor, a pressure regulator may limit a fluid pressure differential by controlling the volumetric flow. One or more nozzles may be configured to automatically regulate a nozzle diameter, and therefore the pressure drop across the nozzle. A surge protector may be connected to the generator.

19 Claims, 8 Drawing Sheets

(56) References Cited

U.S. PATENT DOCUMENTS

| | | | | |
|---|---|---|---|---|
| 2008/0047753 | A1 | 2/2008 | Hall et al. | |
| 2010/0014205 | A1* | 1/2010 | Gerlach | H02H 9/042 361/111 |
| 2013/0192833 | A1 | 8/2013 | Gano et al. | |
| 2014/0008079 | A1 | 1/2014 | Werswick et al. | |
| 2014/0151052 | A1 | 6/2014 | Themig et al. | |
| 2015/0090444 | A1* | 4/2015 | Partouche | E21B 41/0085 166/254.2 |
| 2016/0145975 | A1 | 5/2016 | Carroll et al. | |
| 2016/0237790 | A1 | 8/2016 | Williams | |
| 2016/0265315 | A1 | 9/2016 | Frosell et al. | |
| 2016/0341012 | A1* | 11/2016 | Riley | E21B 41/0085 |
| 2017/0306725 | A1 | 10/2017 | Hunter | |
| 2018/0038197 | A1* | 2/2018 | Janes | E21B 34/06 |
| 2018/0245403 | A1 | 8/2018 | Chambers et al. | |
| 2021/0131204 | A1 | 5/2021 | Marshall et al. | |

OTHER PUBLICATIONS

International Search Report and Written Opinion in International Patent Application No. PCT/US2018/047025, dated Dec. 20, 2018, 14 pages.

International Preliminary Report on Patentability in International Patent Application No. PCT/US2017/047025, dated Mar. 3, 2020, 10 pages.

* cited by examiner

DOWNHOLE TRANSDUCER ASSEMBLIES AND PRESSURE RANGE CONTROL THEREIN

CROSS-REFERENCE TO RELATED APPLICATIONS

This application is a continuation of U.S. patent application Ser. No. 16/639,613, filed Feb. 17, 2020, which is a U.S. national stage entry of International Patent Application No. PCT/US2018/047025 filed Aug. 20, 2018, which claims the benefit of and priority to U.S. Patent Application No. 62/551,804, filed on Aug. 30, 2017, the entirety of each of which is incorporated herein by this reference.

BACKGROUND

Wellbores may be drilled into a surface location or seabed for a variety of exploratory or extraction purposes. For example, a wellbore may be drilled to access fluids, such as liquid and gaseous hydrocarbons, stored in subterranean formations and to extract the fluids from the formations. Wellbores used to produce or extract fluids may be lined with casing around the walls of the wellbore. A variety of drilling methods may be utilized depending partly on the characteristics of the formation through which the wellbore is drilled.

The wellbores may be drilled by a drilling system that drills through earthen material downward from the surface. Some wellbores are drilled vertically downward, and some wellbores have one or more curves in the wellbore to follow desirable geological formations, avoid problematic geological formations, or a combination of the two.

Conventional drilling systems are limited in how rapidly the wellbore can change direction. One of the largest limitations on the steerability of a drilling system is the length of the rigid downhole tools at the downhole end of the drilling system (i.e., near the drill bit). Some of the rigid components include turbomotors, mud motors, rotary steerable systems, and other components that provide energy to move or steer the drill bit.

SUMMARY

In some embodiments, a downhole transducer assembly may include a housing with an inlet, an outlet, a pressure regulator, and a turbine rotationally fixed to a rotor in a generator. The pressure regulator may include a poppet rigidly connected to an elastic member, the poppet configured to at least partially occlude an orifice in the inlet when the elastic member is in a compressed configuration. In some embodiments, the pressure of a diverted portion of drilling fluid may compress the elastic member, thereby creating a pressure regulator.

In other embodiments, a downhole transducer assembly may include a housing with an inlet, an outlet, a pressure regulator, a turbine rotationally fixed to a rotor in a generator, and a surge protector electrically connected to the generator. The surge protector may direct current to an actuator to actuate a valve.

This summary is provided to introduce a selection of concepts that are further described below in the detailed description. This summary is not intended to identify key or essential features of the claimed subject matter, nor is it intended to be used as an aid in limiting the scope of the claimed subject matter.

Additional features and advantages of embodiments of the disclosure will be set forth in the description which follows, and in part will be obvious from the description, or may be learned by the practice of such embodiments. The features and advantages of such embodiments may be realized and obtained by means of the instruments and combinations particularly pointed out in the appended claims. These and other features will become more fully apparent from the following description and appended claims, or may be learned by the practice of such embodiments as set forth hereinafter.

BRIEF DESCRIPTION OF THE DRAWINGS

In order to describe the manner in which the above-recited and other features of the disclosure can be obtained, a more particular description will be rendered by reference to specific embodiments thereof which are illustrated in the appended drawings. For better understanding, the like elements have been designated by like reference numbers throughout the various accompanying figures. While some of the drawings may be schematic or exaggerated representations of concepts, at least some of the drawings may be drawn to scale. Understanding that the drawings depict some example embodiments, the embodiments will be described and explained with additional specificity and detail through the use of the accompanying drawings in which:

FIG. 4-1 is a longitudinal cross section of a drill pipe showing a nozzle in a housing, according to at least one embodiment of the present disclosure;

FIG. 4-2 and FIG. 4-3 are perspective views of a nozzles, according to at least on embodiment of the present disclosure;

FIG. 5-1 is a longitudinal cross section of a nozzle including a rigid insert, according to at least on embodiment of the present disclosure;

FIG. 5-2 is a longitudinal cross section of a nozzle including a deformable ring, according to at least on embodiment of the present disclosure;

DETAILED DESCRIPTION

Figure 1:
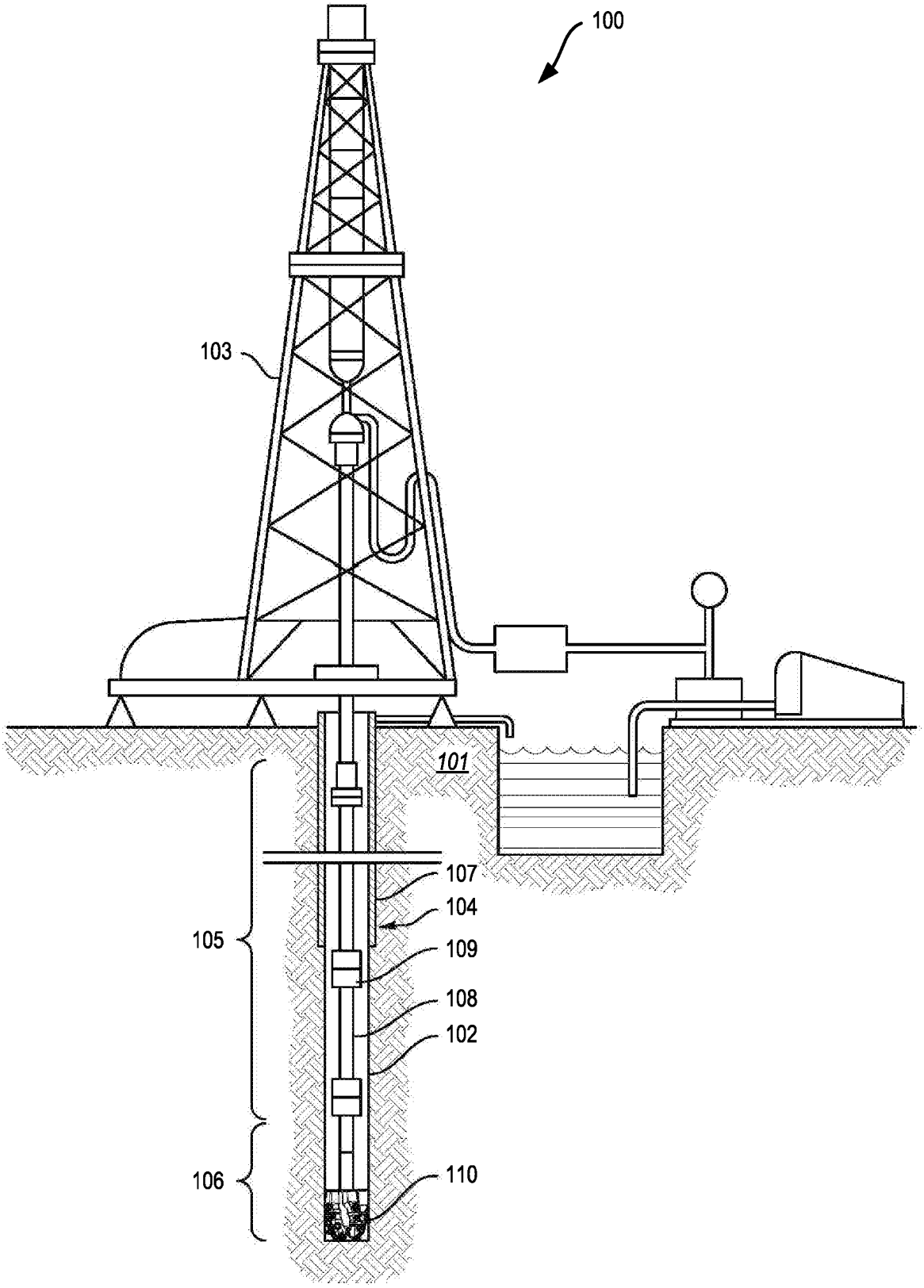
FIG. 1 is a representation of an earth drilling operation, according to at least one embodiment of the present disclosure.

This disclosure generally relates to devices, systems, and methods for regulating the pressure in a downhole transducer assembly to control the voltage experienced by a generator. FIG. 1 shows one example of a drilling system 100 for drilling an earth formation 101 to form a wellbore 102. The drilling system 100 includes a drill rig 103 used to turn a drilling tool assembly 104 which extends downward into the wellbore 102. The drilling tool assembly 104 may include a drill string 105, a bottomhole assembly ("BHA") 106, and a bit 110, attached to the downhole end of drill string 105.

The drill string 105 may include several joints of drill pipe 108 a connected end-to-end through tool joints 109. The drill string 105 transmits drilling fluid through a central bore and transmits rotational power from the drill rig 103 to the BHA 106. In some embodiments, the drill string 105 may further include additional components such as subs, pup joints, etc. The drill pipe 108 provides a hydraulic passage through which drilling fluid is pumped from the surface. The drilling fluid discharges through selected-size nozzles, jets, or other orifices in the bit 110 for the purposes of cooling the bit 110 and cutting structures thereon, and for lifting cuttings out of the wellbore 102 as it is being drilled.

The BHA 106 may include the bit 110 or other components. An example BHA 106 may include additional or other components (e.g., coupled between to the drill string 105 and the bit 110). Examples of additional BHA components include drill collars, stabilizers, measurement-while-drilling ("MWD") tools, logging-while-drilling ("LWD") tools, downhole motors, underreamers, section mills, hydraulic disconnects, jars, vibration or dampening tools, other components, or combinations of the foregoing.

In general, the drilling system 100 may include other drilling components and accessories, such as special valves (e.g., kelly cocks, blowout preventers, and safety valves). Additional components included in the drilling system 100 may be considered a part of the drilling tool assembly 104, the drill string 105, or a part of the BHA 106 depending on their locations in the drilling system 100.

The bit 110 in the BHA 106 may be any type of bit suitable for degrading downhole materials. For instance, the bit 110 may be a drill bit suitable for drilling the earth formation 101. Example types of drill bits used for drilling earth formations are fixed-cutter or drag bits. In other embodiments, the bit 110 may be a mill used for removing metal, composite, elastomer, other materials downhole, or combinations thereof. For instance, the bit 110 may be used with a whipstock to mill into casing 107 lining the wellbore 102. The bit 110 may also be a junk mill used to mill away tools, plugs, cement, other materials within the wellbore 102, or combinations thereof. Swarf or other cuttings formed by use of a mill may be lifted to surface, or may be allowed to fall downhole.

Figure 2:
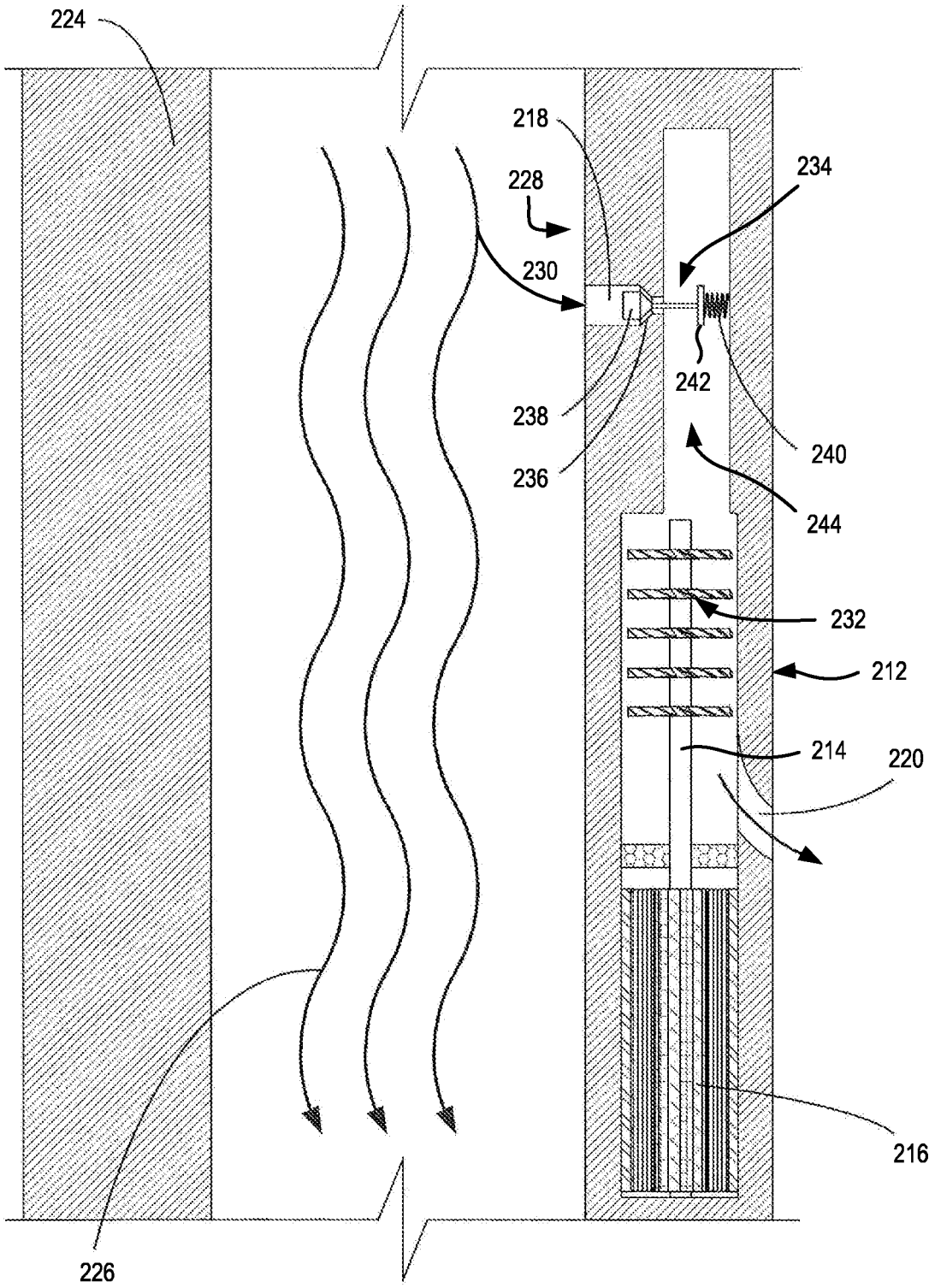
FIG. 2. is a longitudinal cross section of a drill pipe showing a pressure regulator in conjunction with downhole transducer assembly, according to at least one embodiment of the present disclosure.

Referring now to FIG. 2, in some embodiments, a downhole transducer assembly 212 may be housed in a housing, the housing including a turbine 214, a generator 216, an inlet 218, an outlet 220, and a pressure regulator 234. A drilling fluid 226 may flow through a section of drill pipe 224. In some embodiments, the drill pipe 224 may include an inlet 218 opening on an internal surface 228 of the drill pipe 224. A portion 230 of the drilling fluid 226 may be diverted into the inlet 218 toward the downhole transducer assembly 212. In some embodiments, the turbine 214 may convert kinetic energy from the diverted portion 230 of drilling fluid 226 into rotational energy. For example, the turbine 214 may include a series of axial fans 232, each comprising a plurality of blades extending from a center shaft. In other examples, the turbine 214 may include a fighting rotated around a center shaft, similar to an auger. In some embodiments, the turbine 214 may be rotatable in direct relation to a fluid pressure differential across the inlet 218 and an exterior of the outlet 220. For example, a high fluid pressure differential may cause the turbine 214 to rotate with a high angular velocity, and a low fluid pressure differential may cause the turbine 214 to rotate with a low angular velocity. In some embodiments, the turbine 214 may be rotationally fixed to a rotor within the generator 216, converting the rotational energy into electricity for use by a variety of downhole tools.

In some embodiments, a high angular velocity may cause damage to many parts of the downhole transducer assembly 212, including: the turbine 214, the rotor, the generator 216, electrical components, downhole tools, and/or other parts. For example, a high angular velocity may generate too much current and/or voltage in the generator 216, which may cause it to overheat or be damaged in some other way. In other examples, excess current and/or voltage in the generator 216 may be transferred through an electrical circuit and overpower downhole tools, electrical components, and so forth. In still other examples, a high angular velocity may impose a high centrifugal force on the turbine 214 and/or rotor, which may cause it to break down, damaging the housing and/or the generator 216.

In some embodiments, an outlet 220 may discharge the diverted portion 230 of drilling fluid 226 from the housing. For example, the outlet 220 may discharge the diverted portion 230 to the exterior of the drill pipe 224. In other examples, the outlet 220 may discharge the diverted portion 230 back into the interior of the drill pipe 224. In still other examples, the outlet 220 may discharge the diverted portion 230 to a chamber, separate from the housing for the downhole transducer assembly 212.

In some embodiments, the downhole transducer assembly 212 may include a pressure regulator 234. The pressure regulator 234 may be configured to regulate the fluid pressure differential across the inlet 218 and an exterior of the outlet 220. In some embodiments, the fluid pressure differential may be regulated to range having an upper value, a lower value, or upper and lower values including any of 200 psi (1,380 kPa), 250 psi (1,720 kPa), 300 psi (2,070 kPa), 350 psi (2,410 kPa), 400 psi (2,760 kPa), 450 psi (3,100 kPa), 500 psi (3,450 kPa), 1,000 psi (6,900 kPa), 1,500 psi (10,300 kPa), 2,000 psi (13,800 kPa), 2,500 psi (17,200 kPa), 3,000 psi (20,700 kPa), or any values therebetween. For example, the fluid pressure differential may be greater than 200 psi (517 kPa). In other examples, the fluid pressure differential may be less than 3,000 psi (8,270 kPa). In yet other examples, the fluid pressure differential may be in a range of 200 psi (517 kPa) to 3,000 psi (8,270 kPa).

The fluid pressure differential may affect a fluid volumetric flow. A fluid volumetric flow, flowing across the turbine 214 may cause the turbine 214 to rotate with an angular velocity. For example, the turbine may rotate clockwise in response to a fluid volumetric flow. In other examples, the turbine may rotate counterclockwise in response to a fluid volumetric flow. In some embodiments, the angular velocity may be in range having an upper value, a lower value, or upper and lower values including any of 0 rpm, 5,000 rpm, 10,000 rpm, 15,000 rpm, 20,000 rpm, 25,000 rpm, 30,000 rpm, 35,000 rpm, or any values therebetween. For example, the angular velocity may be greater than 0 rpm. In other examples, the angular velocity may be less than 35,000 rpm. In yet other examples, the angular velocity may be in a range of 0 rpm to 35,000 rpm.

In some embodiments, the pressure regulator 234 may restrict the diverted portion 230 by occluding at least a portion of the inlet 218. In some embodiments, the pressure regulator 234 may be disposed between the inlet 218 and the turbine 214. The inlet 218 may include an orifice 236 through which the diverted portion 230 may pass. A poppet 238 may be positioned to restrict flow through the orifice 236. In some embodiments, the poppet 238 may be movable relative to the orifice 236. An elastic member 240 may be rigidly connected to the poppet 238 and include a pressure plate 242. In some embodiments, in a collapsed configuration of the elastic member 240, the poppet 238 may at least partially occlude the orifice 236. In other embodiments, in a collapsed configuration of the elastic member 240, the poppet 238 may completely occlude the orifice 236. In some embodiments, the elastic member 240 may exert an opposing force against the fluid pressure exerted by the diverted portion 230 passing over the poppet 238 and against the pressure plate 242 and elastic member 240 in the turbine chamber 244. If the fluid pressure is greater than the opposing elastic force applied by the elastic member 240, the elastic member 240 may move toward a compressed configuration, and the poppet 238 may be moved toward the orifice 236 to restrict flow through the inlet 218. In some embodiments, the pressure plate 242 may increase the area against which the fluid pressure may be exerted, thereby increasing the force against the elastic member 240. In this manner, the pressure regulator 234 may be an automatic pressure regulator, automatically regulating the fluid pressure differential and the flow through the inlet 218.

In some embodiments, a solenoid may be connected to the pressure plate 242. The solenoid may actuate the pressure plate 242, thereby causing the poppet 238 to move relative to the orifice 236. In some embodiments, the solenoid may be actuated using electrical current generated by the downhole transducer assembly 212. In other embodiments, the solenoid may be actuated using electrical current generated from a different downhole power generator. In still other embodiments, the solenoid may be actuated using electrical current provided from the surface. Actuation of the solenoid may be controlled by a computing device, which may regulate pressure across the downhole transducer assembly 212 according to prescribed parameters.

In some embodiments, the inlet 218 may include a nozzle. The poppet 238 may be sized to fit within the nozzle. In some embodiments, the pressure regulator 234 may be installed simultaneously with the nozzle.

In some embodiments, the pressure regulator may be located completely within the turbine chamber 244. For example, the poppet 238 may be located inside the turbine chamber 244, and partially occlude the orifice 236 from the inside of the turbine chamber 244. In other examples, the pressure regulator may be disposed parallel to the direction of flow inside the turbine chamber 244. The poppet may have substantially the same profile as the turbine chamber 244. For example, a turbine chamber 244 may have a circular lateral cross section, and the poppet have a circular lateral cross section. In other examples, a turbine chamber 244 may have a square or rectangular lateral cross section, and the poppet may have a square or rectangular lateral cross section. In still other examples, a turbine chamber 244 may have any shape lateral cross section, and the poppet may have a complementary or matching lateral cross section. In a collapsed configuration of the elastic member 240, the poppet may not occlude any of the orifice 236. As the elastic member 240 expands to a relaxed state, the poppet may partially or completely occlude the orifice 236 from the interior of the turbine chamber 244.

In some embodiments, the poppet 238 may have a cubical shape. In other embodiments, the poppet 238 may have a pyramidal or conical shape. In some embodiments, the peak of the pyramid or cone may point toward the orifice 236. In still other embodiments, the poppet 238 may have a spherical or ellipsoidal shape. In yet other embodiments, the poppet 238 may have an irregular solid shape. In other embodiments, the poppet 238 may have a shape including a combination of two or more conventional solids.

In some embodiments, the poppet 238 may be complimentarily shaped to the orifice 236. For example, both the poppet 238 and the orifice 236 may have a circular cross-sectional shape. In other embodiments, the poppet 238 may have a different cross-sectional shape from the orifice 236. For example, the poppet 238 may have a square or rectangular cross-sectional shape, and the orifice 236 may have a circular cross-sectional shape. In some embodiments, the poppet 238 may have a larger cross-sectional area than the orifice 236. In other embodiments, the poppet 238 may have a smaller cross-sectional area than the orifice 236.

In some embodiments, the poppet 238 may be solid. In other embodiments, the poppet 238 may be perforated with one or more perforations. With the elastic member 240 in a collapsed configuration, a perforated poppet 238 may allow at least some fluid flow through the orifice 236, even if the poppet 238 is in contact with the orifice 236. The poppet 238 may have 0, 1, 2, 3, 4, 5, 6, 7, 8, 9, 10, or more perforations. Any number of suitable perforations may be used to allow sufficient fluid flow through the orifice 236 when the poppet or other pressure regulator is in a closed position (i.e., when it would otherwise substantially block the flow).

Figure 3:
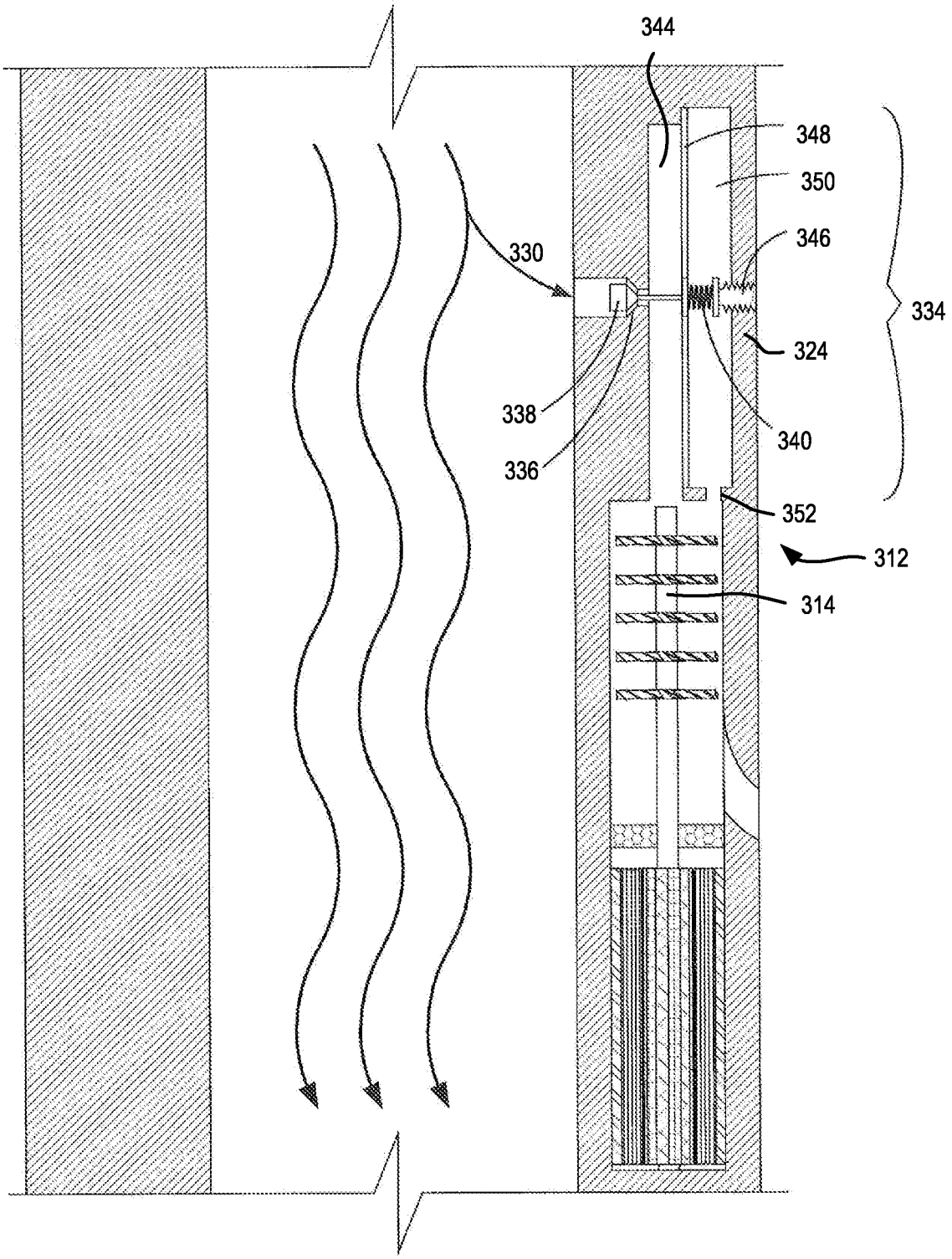
FIG. 3 is a longitudinal cross section of a drill pipe showing a pressure regulator with a diaphragm in conjunction with downhole transducer assembly, according to at least one embodiment of the present disclosure.

Referring to FIG. 3, a downhole transducer assembly 312 includes a pressure regulator 334. In some embodiments, an adjuster 346 may be installed in the housing, and adjust the positioning of the elastic member 340 relative to the orifice 336. Adjusting the position of the elastic member 340 may adjust the position of the poppet 338, which may alter the volume and pressure of the diverted portion 330 that enters the turbine chamber 344. In this manner, the fluid pressure differential maintained by the pressure regulator 334 may be adjusted. In some embodiments, the adjuster 346 may be installed in the wall of the housing. For example, the adjuster 346 may include a screw screwed into the side wall of the drill pipe 324. In other examples, the adjuster 346 may be inserted into the housing and retained with a pin. In some embodiments, the adjuster 346 may be accessible from the exterior of the housing.

In some embodiments, the pressure regulator 334 may include a diaphragm 348 and a diaphragm chamber 350. The diaphragm chamber 350 may include a diaphragm chamber inlet 352, connecting the diaphragm chamber 350 to the remainder of the turbine chamber 344. As the fluid pressure differential changes, the diaphragm 348 may extend and distend relative to the diaphragm chamber 350, thus altering the position of the poppet 338 and its occlusion of the orifice 336. When the diaphragm 348 extends into the diaphragm chamber 350, fluid may flow from the diaphragm chamber 350, through the diaphragm chamber inlet 352, and into the turbine chamber 344. When the diaphragm 348 distends from the diaphragm chamber 350, fluid may flow from the turbine chamber 344, through the diaphragm chamber inlet 352, and into the diaphragm chamber 350. In some embodiments, the diaphragm chamber inlet 352 may be sized such that the fluid transfer between the diaphragm chamber 350 and the turbine chamber 344 occurs gradually. For example, the diaphragm 348 and the diaphragm chamber 350 may act as a dampener, dampening sudden changes in fluid pressure differential. This may reduce over-speeding of the turbine 314, and reduce sudden spikes in electricity (e.g., power) generation in the generator 216.

In some embodiments, the diaphragm chamber inlet 352 may be located in one of the walls of the diaphragm chamber 350. In other embodiments, the diaphragm chamber inlet 352 may be located on the diaphragm 348. In still other embodiments, the diaphragm chamber inlet 352 may be located in both one of the walls of the diaphragm chamber 350 and the diaphragm 348. Any suitable number of diaphragm chambers may be used, e.g., there may be 0, 1, 2, 3, 4, 5, 6, 7, 8, 9, or 10 diaphragm chamber inlets 352.

In some embodiments, the diaphragm 348 may include a flexible membrane, connected at the top and bottom of the diaphragm chamber 350. In this manner, the diaphragm 348 may flexibly extend into the diaphragm chamber 350 in the event of an overpressure, and flexibly distend from the diaphragm chamber 350 in the event of an underpressure. In some embodiments, the flexible membrane diaphragm 348 may serve as the elastic member 340. In other embodiments, the flexible membrane diaphragm 348 may work together with the elastic member 340.

In some embodiments, the diaphragm 348 may be rigid. The rigid diaphragm 348 may be sized with approximately the same profile as the inner profile of the diaphragm chamber 350. In some embodiments, the rigid diaphragm 348 may have a clearance between the profile of the rigid diaphragm 348 and the diaphragm chamber 350. In some embodiments, the clearance may be sized such that no fluid passes from the diaphragm chamber 350 to the turbine chamber 344 through the clearance. In other embodiments, the clearance may be sized such that fluid flows between the diaphragm chamber 350 and the turbine chamber 344 through the clearance. In some embodiments, the clearance may act as a diaphragm chamber inlet.

In some embodiments, the diaphragm 348 may include both rigid and flexible materials. For example, the radially inward portion of the diaphragm 348 may be rigid, and the radially outward portion of the diaphragm 348 may be flexible. In other examples, the radially inward portion of the diaphragm 348 may be flexible, and the radially outward portion of the diaphragm 348 may be rigid. In some embodiments, an entire radial segment may be rigid or flexible. For example, a 45° segment of the diaphragm 348 may be rigid. In other examples, a 180° segment of the diaphragm 348 may be flexible. In some examples, the diaphragm 348 may alternate between rigid and flexible radial segments.

Referring back to FIG. 3, in some embodiments, the poppet 338 may include an erosion-resistant material, such as a hard or ultrahard material. For example, the poppet 338 may be fabricated from polycrystalline diamond (PCD), polycrystalline cubic boron nitride, or the like. In other examples, the poppet 338 may be fabricated from a metal carbide, such as tungsten carbide (WC), an erosion resistant metal or alloy, or the like.

In some embodiments, the orifice 336 may include an erosion-resistant material. For example, the orifice 336 may be fabricated from any of the materials described above with respect to the poppet, such as PCD. In other examples, the orifice 336 may be fabricated from a metal carbide, such as WC. Utilizing an erosion resistant material on the poppet and/or the orifice may reduce the wear experienced from the passage of high-velocity fluids, including abrasive drilling muds.

In some embodiments, the elastic member 340 may include a metal spring. For example, the elastic member 340 may include a coil spring. In other examples, the elastic member 340 may include a leaf or a flat spring.

Figures 1, 4:
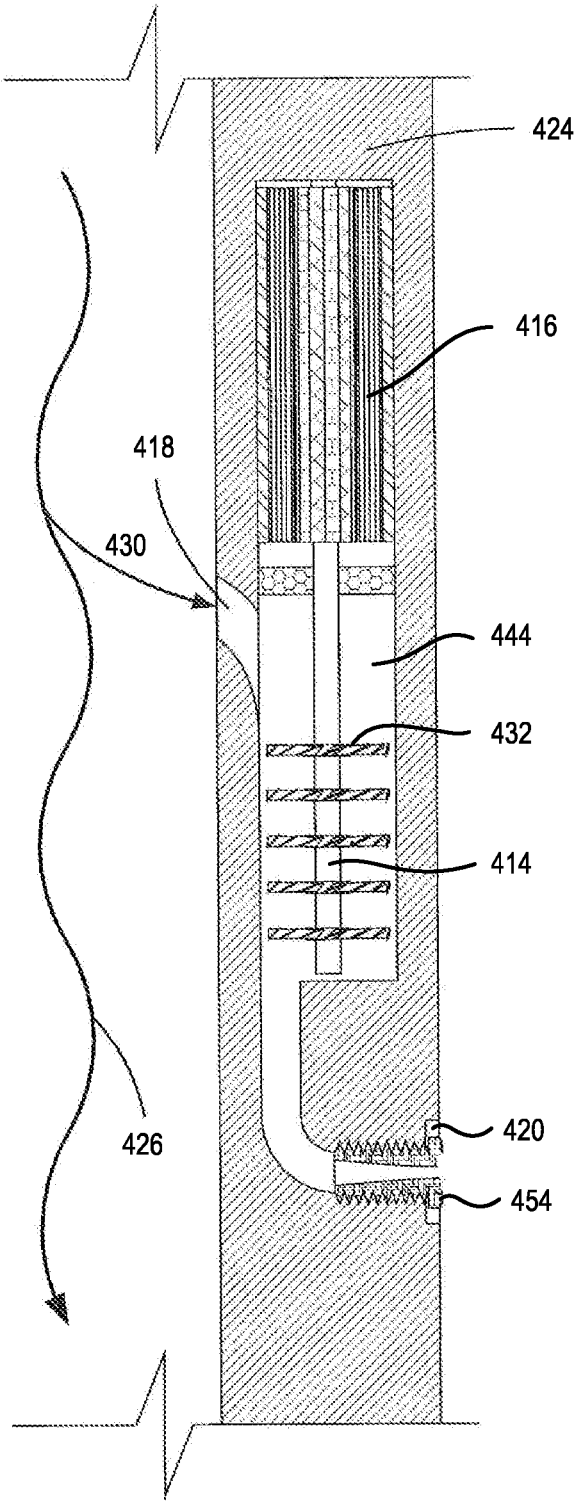
Figures 2, 4:
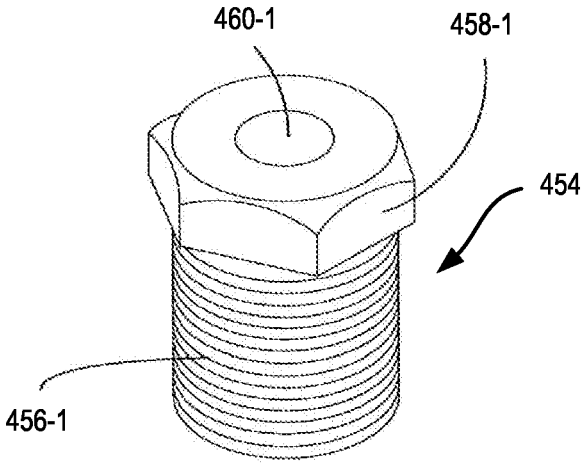
Figures 3, 4:
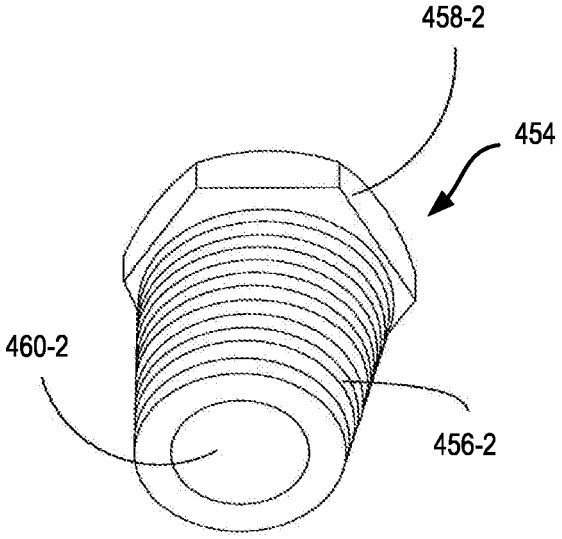

Referring now to FIG. 4-1, in some embodiments, the pressure regulator may be a nozzle 454. An inlet 418 may divert a portion 430 of a drilling fluid 426 flowing through a section of drill pipe 424 into the turbine chamber 444. The diverted portion 430 may have a fluid pressure differential between the inlet 418 and the outlet 420. The diverted portion 430 may engage the axial fans 432, rotating the turbine 414 with an angular velocity in direct relation to the fluid pressure differential. A rotor, rotationally fixed to the turbine 414, may be rotated within the generator 416, generating electricity for use in downhole tools. After the diverted portion 430 passes through the series of axial fans 432, it may discharge through an outlet 420. In some embodiments, the outlet 420 may include a nozzle 454. In other embodiments, the inlet 418 may include a nozzle. In some embodiments, both the inlet 418 and the outlet 420 may include a nozzle.

In some embodiments, the inlet to outlet ratio, which may be defined as the area of the inlet relative to the area of the outlet, may affect the fluid pressure differential. For example, a small outlet area relative to a larger inlet area may increase the fluid pressure differential. A large outlet area relative to an inlet area may decrease the fluid pressure differential.

In some embodiments, the inlet to outlet ratio may be in a range having an upper value, a lower value, or upper and lower values including any of 1:1, 1.5:1, 2:1, 2.5:1, 3:1, 3.5:1, 4:1, 4.5:1, 5:1, or any values therebetween. For example, the inlet to outlet ratio may be greater than 1:1. In other examples, the inlet to outlet ratio may be less than 5:1. In yet other examples, the inlet to outlet ratio may be in a range of 1:1 to 5:1.

In some embodiments, an easily replaceable nozzle, accessible from the exterior of the housing, may allow for adjustable pressure drop control. For instance, FIG. 4-2 and FIG. 4-3 each illustrate an embodiment of a threadable nozzle 454. The threadable nozzle 454 may include a generally tubular body including threads 456-1 and 456-2 on one end and a head 458-1 and 458-2 on an opposing end. A fluid passage 460-1 and 460-2 may traverse the threadable nozzle 454 from the one end to the other. As the fluid passage 460-1 and 460-2 is likely to experience rapid fluid flow therethrough, it may include an erosion resistant material, such as those described above with respect to the poppet (e.g., tungsten carbide or PCD), to withstand associated wear. Complementary threads to threads 456-1 and 456-2 may be disposed in the housing to retain the threadable nozzle 454 and allow for rapid replacement. In some embodiments, a variety of other quick-change mechanisms may produce similar results. For example, the nozzles may be installed using a drop-pin. In other examples, the nozzles may be installed using a mechanical latch.

Figures 1, 5:
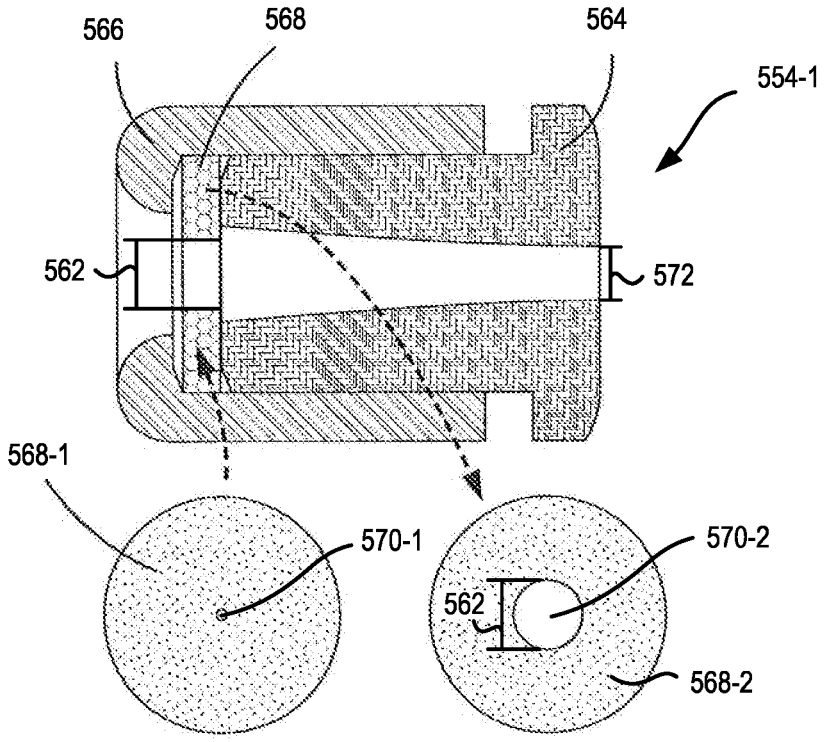
Figures 2, 5:
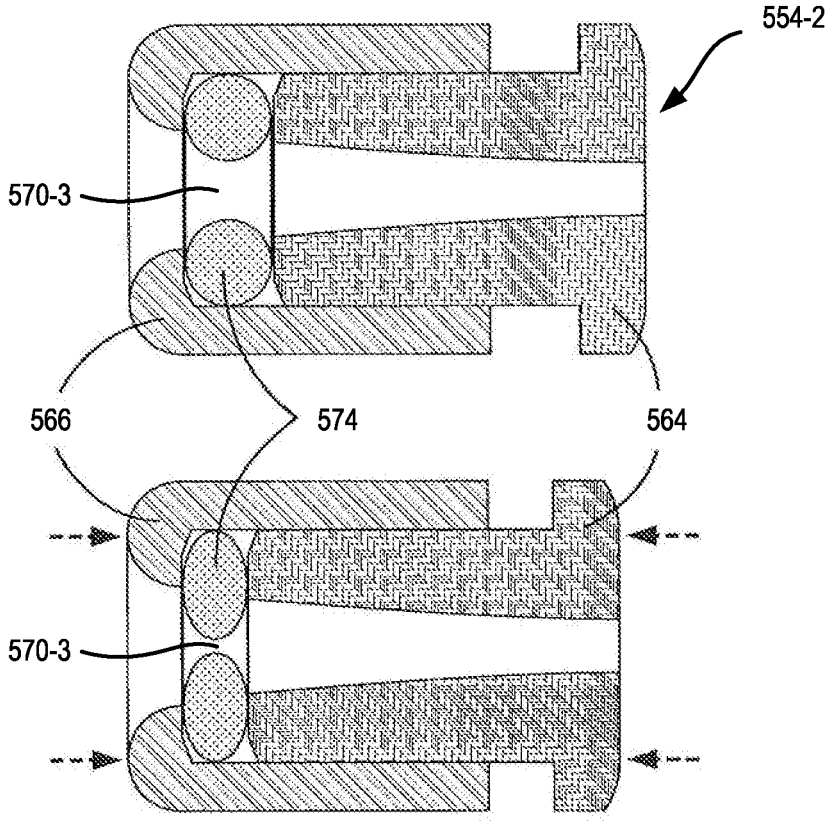

Referring now to FIG. 5-1, in some embodiments, the nozzle 554-1 may include an adjustable nozzle area. In some embodiments, the nozzle 554-1 may include a nozzle inlet area 562 that is different from the nozzle outlet area 572. The smaller of the nozzle inlet area 562 and the nozzle outlet area 572 is the nozzle area. The nozzle 554-1 may include a plug 564 that may be received within a nozzle housing 566. A nozzle plate 568 may be located between the nozzle housing 566 and the plug 564. The nozzle plate 568 may include an aperture 570-1, through which fluid may pass. In some embodiments, the aperture 570-1 may have a smaller area than either the nozzle inlet area 562 or the nozzle outlet area 572. In that embodiment, the nozzle area will equal the aperture 570-1 area.

In some embodiments, the nozzle plate 568 may be replaceable to adjust the pressure drop across the nozzle 554-1. For example, a nozzle plate 568-1 with an aperture 570-1 may be replaced with a nozzle plate 568-2 with a larger aperture 570-2, thereby decreasing the pressure drop across the nozzle 554. The nozzle plate 568 may be replaced by removing the plug 564 from the nozzle housing 566, removing the first nozzle plate 568-1 from the nozzle housing 566, inserting the second nozzle plate 568-2 into the nozzle housing 566, and then replacing the plug 564 in the nozzle housing 566. While only two nozzle plates have been described, any number of different nozzle plates with varying geometries of apertures may be switched into the adjustable nozzle shown to achieve different pressure drops. In some embodiments, the nozzle plate 568 may be fabricated from an erosion resistant material such as those described above with respect to the poppet. For example, the nozzle plate 568 may be fabricated from PCD. In other examples, the nozzle plate 568 may be fabricated from tungsten carbide. In some embodiments, utilizing an erosion resistant material may reduce the wear experienced by the nozzle plate from the passage of high-velocity fluids, including abrasive drilling muds.

In some embodiments, the aperture area may be in range having an upper value, a lower value, or upper and lower values including any of 0.00785 sq. in. (5.07 sq. mm), 0.0314 sq. in. (20.2 sq. mm), 0.0707 sq. in. (45.6 sq. mm), 0.126 sq. in. (81.1 sq. mm), 0.196 sq. in. (126.1 sq. mm), 0.283 sq. in. (182 sq. mm), 0.385 sq. in. (248 sq. mm), 0.503 sq. in. (324 sq. mm), 0.636 sq. in. (410 sq. mm), 0.785 sq. in. (507 sq. mm), or any values therebetween. For example, the aperture area may be greater than 0.00785 sq. in. (5.07 sq. mm). In other examples, the aperture area may be less than 0.785 sq. in. (507 sq. mm). In yet other examples, the aperture area may be in a range of 0.00785 sq. in. (5.07 sq. mm) to 0.785 sq. in. (507 sq. mm).

Referring to FIG. 5-2 in some embodiments, the nozzle 554-2 may be an automatically regulating nozzle based on pressure experienced by the nozzle. The nozzle 554-2 may include a plug 564 that may be received within a nozzle housing 566. A deformable ring 574 may be located between the nozzle housing 566 and the plug 564. The deformable ring 574 may have a toroidal shape, allowing fluid to flow through an aperture 570-3 therein. In some embodiments, as a pressure drop across the nozzle 554-2 increases, the deformable ring 574 may be squeezed between the nozzle housing 566 and the plug 564. The compressive forces acting on the deformable ring 574 may cause it to deform. In some embodiments, the deformed ring may reduce the area of the aperture 570-3. The reduced area of the aperture 570-3 may reduce the nozzle area, resulting in an increased pressure drop.

In some embodiments, the deformable ring 574 may have an aperture reduction factor, which is the percentage by which the aperture 570-3 may be reduced. An infinite aperture reduction factor would effectively close the aperture 570-3. In some embodiments the aperture reduction factor may be in a range having an upper value, a lower value, or upper and lower values including any of 25%, 50%, 75%, 100%, 125%, 150%, 175%, 200%, infinite, or any values therebetween. For example, aperture reduction factor may be greater than 25%. In other examples, the aperture reduction factor may be less than infinite. In yet other examples, the aperture reduction factor may be in a range of 25% to infinite.

In some embodiments, the deformable ring 574 may be fabricated from an elastic material, such that when the compressive forces release, the deformable ring 574 returns from a compressed configuration to an open configuration. For example, the deformable ring 574 may be fabricated from an elastic polymer. In other examples, the deformable ring 574 may be fabricated from a rubber. In other embodiments, the deformable ring 574 may be fabricated from a non-elastic material, such that when the compressive forces release, the deformable ring 574 remains in a compressed configuration, and does not return, or only partially returns to an open configuration. For example, the deformable ring 574 may be fabricated from steel.

Figure 6:
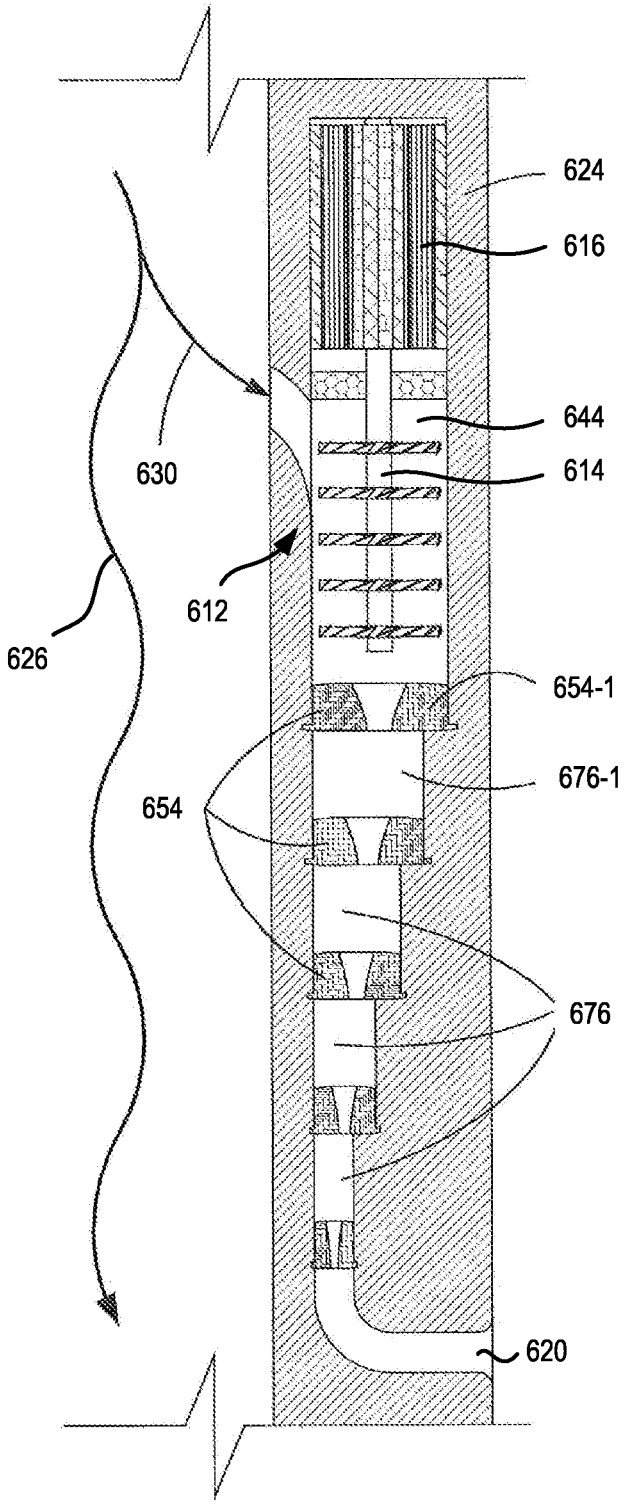
FIG. 6 is a longitudinal cross section of a drill pipe showing a plurality of nozzles and fluid chambers in series, according to at least one embodiment of the present disclosure.

Referring to FIG. 6, in some embodiments, a downhole transducer assembly 612 may include a plurality of nozzles 654 in fluid communication. In some embodiments, the plurality of nozzles 654 in fluid communication may be placed in series. In this manner, a pressure drop may be accomplished gradually. In some embodiments, a gradual pressure drop may reduce fluid velocities, thereby reducing wear on various components. In some embodiments, a chamber 676 may be disposed between two adjacent nozzles. For example, a diverted portion 630 of drilling fluid 626 may enter a turbine chamber 644 through a lateral sidewall of a drill pipe 624. After rotating a turbine 614, the diverted portion 630 may pass through a first nozzle 654-1 into a first chamber 676-1. The diverted portion 630 may experience a first pressure drop over the first nozzle 654-1 before collecting in the first chamber 676-1. The diverted portion 630 may then pass through subsequent nozzles and cavities, experiencing a pressure drop at each nozzle. Through such a configuration, a significant total pressure drop may be achieved in a relatively small space, such as within the lateral sidewall of the drill pipe 624.

In some embodiments, each chamber 676 may function as a housing for a downhole instrument. For example, the first chamber 676-1 may function as a housing for a turbine and generator assembly, which may be in the same electrical circuit as the generator 616, or may be in a different electrical circuit as the generator 616. In other examples, each chamber 676 may include a turbine and generator assembly, and each of the turbine and generator assemblies may be in the same circuit, different circuits, or any number of turbine and generator assemblies may be in the same circuit. In still other examples, a chamber may include one or more sensors to measure drilling properties, such as temperature, pressure, vibration, and so forth. In some embodiments, different chambers 676 may house different tools and/or sensors. For example, a first chamber may house a turbine and generator assembly, a second chamber may house a temperature sensor, and a third chamber may house a vibration sensor. In other examples, a first and second chamber may house a turbine and generator assembly, and a third chamber may house a pressure sensor. In other embodiments, one or more of the chambers 676 may be empty save for the diverted portion 630. In some embodiments, there may be one chamber 676. In other embodiments, there may be two, three, four, five, or six chambers 676.

Figure 7:
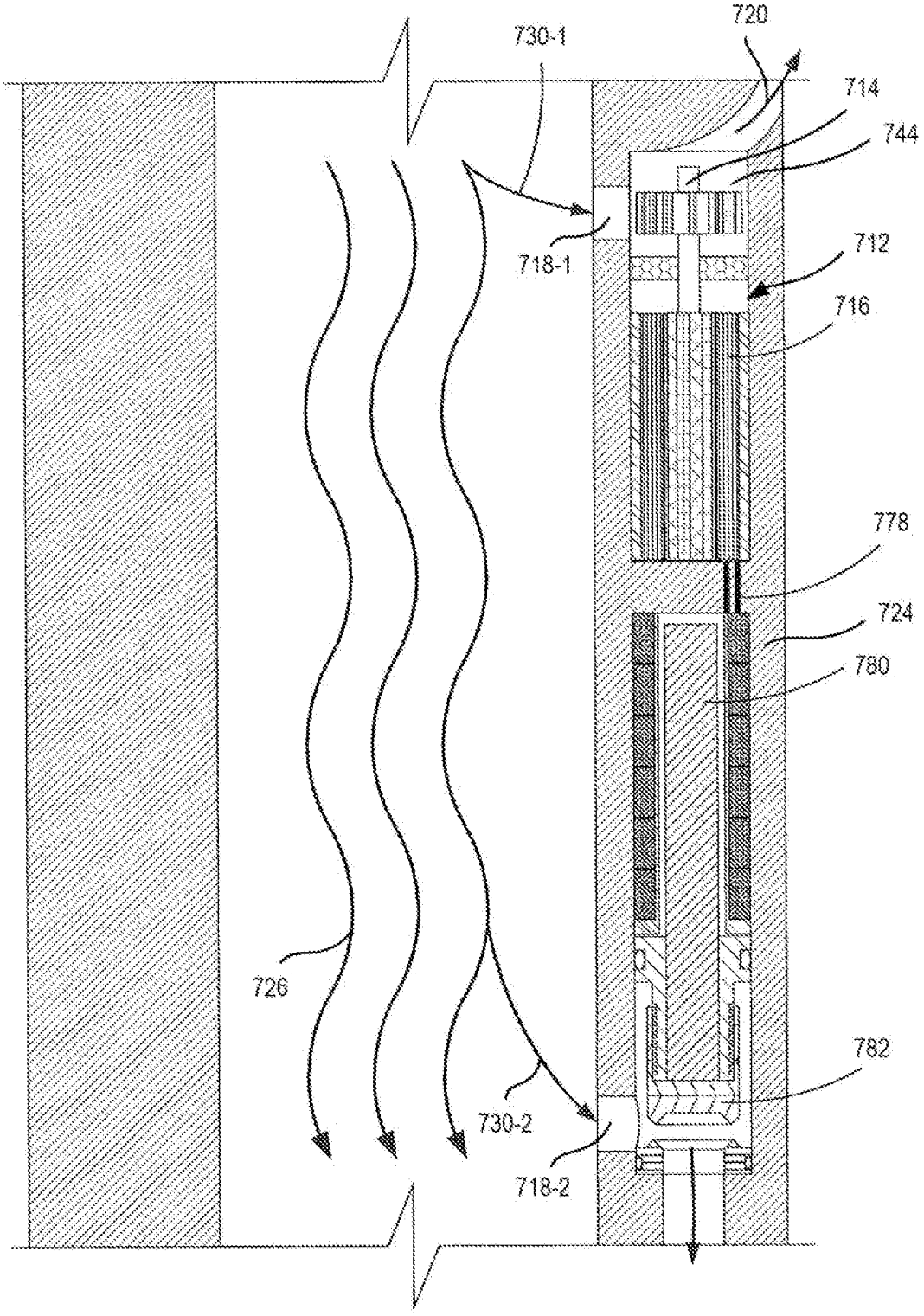
FIG. 7 is longitudinal cross section of a drill pipe showing a surge protector in electrical connection with the generator, according to at least one embodiment of the present disclosure.

FIG. 7 represents a downhole transducer assembly 712 including a turbine 714 rotationally fixed to a rotor within a generator 716, according to at least one embodiment of the present disclosure. In some embodiments, a surge protector 778 may be in electrical connection to the generator 716. A first diverted portion 730-1 of drilling fluid 726 may flow into a turbine chamber 744 through a first inlet 718-1 and out an outlet 720. In some embodiments, the first diverted portion 730-1 may rotate the turbine 714, thereby rotating the rotor in the generator 716 and generating an electric current. In some embodiments, the electric current may power an actuator 780, which may actuate a valve 782. In some embodiments, actuation of the valve 782 may divert a second portion 730-2 of drilling fluid 726 through a second inlet 718-2. The second diverted portion 730-2 may then be routed to a chamber or housing. In some embodiments, the chamber or housing may house a turbine and generator assembly or any other downhole tool or device. In other embodiments, the chamber or housing may house any of the instruments and/or sensors referenced and described in FIG. 6.

In some embodiments, the actuator 780 may be a solenoid. In other embodiments, the actuator 780 may be a motor. In still other embodiments, the actuator may be a servomotor. In yet other embodiments, the actuator 780 may be a linear induction motor. In other embodiments, the actuator 780 may be any type of motor or electrically powered device that may actuate a valve. In some embodiments the valve may be a linear valve. In other embodiments, the valve may be a rotary valve. In still other embodiments, the valve may be any type of valve actuatable by a motor.

In some embodiments, the surge protector 778 may protect the generator 716 and possibly other tools from voltage spikes that may result from pressure spikes in the first diverted portion 730-1 and the drilling fluid 726. For example, when voltage in the generator 716 peaks above a surge voltage, the surge protector 778 may electrically connect the generator 716 with the actuator 780, diverting current, reducing the total voltage sustained by the generator 716, and reducing the angular velocity of the rotor and the turbine 714. In this manner, the actuator may provide capacity to absorb voltage spikes to protect the generator 716 and other tools.

In some embodiments, the surge protector 778 may direct electric current to a downhole tool or instrument. For example, the surge protector 778 may direct the electric current to an actuator that actuates a valve to restrict the inlet 718-1 or outlet 720, such as the pressure reducer described in FIG. 2 and FIG. 3. In other examples, the surge protector 778 may direct electric current to a sensor or group of sensors, such as temperature, pressure, vibration, and other sensors. In some embodiments, the surge protector 778 may direct electric current to a battery or other energy storage device. In other embodiments, the surge protector 778 may ground the generator 716. For example, the surge protector 778 may ground the generator 716 to the drill pipe 724.

In some embodiments, the surge protector 778 may be a metal oxide varistor. In other embodiments, the surge protector 778 may be a gas discharge tube, transzorb or zener diode. In still other embodiments, the surge protector 778 may be a current limiting device (e.g., a current limiter). In yet other embodiments, the surge protector 778 may be a voltage limiting device.

Figure 8:
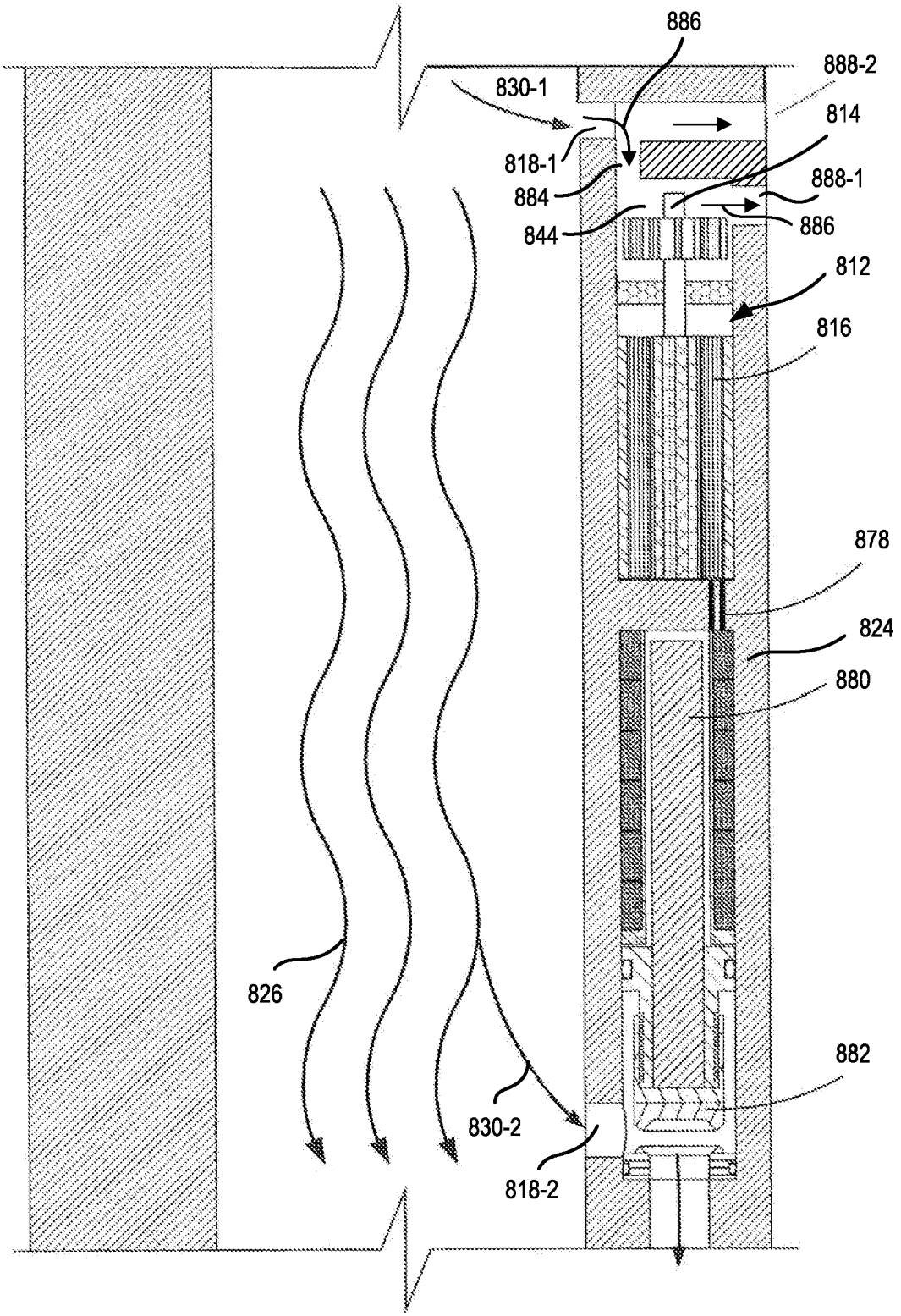
FIG. 8 is a longitudinal cross section of a drill pipe showing a branch of an inlet to a transducer assembly, according to at least one embodiment of the present disclosure.

FIG. 8 is an embodiment of a downhole transducer assembly. The downhole transducer assembly has a first inlet 818-1 located above the turbine chamber 844. The first inlet 818-1 may have a nozzle or may be designed (e.g., sized) to restrict the opening of the first inlet 818-1 to control the pressure drop. As described above, the nozzle may be replaceable to accommodate a number of desired pressure drops. A turbine chamber inlet 884 may branch off of the first inlet 818-1 and place the first inlet 818-1 in fluid communication with the turbine chamber 844. A first portion 830-1 of drilling fluid 826 may enter the first inlet 818-1. A turbine flow 886 may be diverted from the first portion 830-1 into the turbine chamber 844 and out of the turbine chamber outlet 888-1. In some embodiments, the turbine flow 886 may be diverted to any individual chamber or downhole tool, or any combination of chambers or downhole tools, discussed in relation to FIG. 6. In other embodiments, the turbine flow 886 may be diverted out of the turbine chamber outlet 888-1 and into the wellbore. In some embodiments, a portion of the first portion 830-1 may be diverted through the first inlet 818-1 to an outlet 888-2. The outlet 888-2 may have a nozzle or may be designed (e.g., sized) to restrict the opening of the outlet to control the pressure drop to control the pressure of the fluid entering the turbine chamber 844. As described above, the nozzle may be replaceable to accommodate a number of desired pressure drops.

In some embodiments, the first inlet 818-1 may be in fluid communication with additional chambers and tools, such as those disclosed in reference to FIG. 6. In other embodiments, the first inlet 818-1 may be in fluid communication with the valve 882. For example, the first portion 830-1 may be diverted through the valve 882 when the valve 882 is activated, as disclosed in reference to FIG. 7. In some embodiments, the first portion 830-1 may be diverted to the valve 882 through a pathway (not shown) after entering the first inlet 818-1 without traveling through the turbine chamber 844. The first inlet 818-1 may be in fluid communication with the valve 882, separate from the main flow of drilling fluid 826 and the flow of fluid to the turbine chamber 844, such that a portion of the first portion 830-1 may be diverted to the valve 882 (without rejoining the drill fluid 826). In some embodiments, inlet 818-2 may be omitted. In some embodiments, outlet 888-2 may not be present, and at least a portion of the first portion 830-1 of drilling fluid may be diverted to the valve 882 through a pathway in the assembly or tool body without passing through the turbine chamber 844. In some embodiments, a second inlet 818-2 may divert a second portion 830-2 of drill fluid 826 through the valve 882. In some embodiments, a valve may close one or both of the first inlet 818-1 and 818-2.

The embodiments of the pressure and current regulators have been primarily described with reference to wellbore drilling operations; the pressure and current regulators described herein may be used in applications other than the drilling of a wellbore. In other embodiments, pressure and current regulators according to the present disclosure may be used outside a wellbore or other downhole environment used for the exploration or production of natural resources. For instance, pressure and current regulators of the present disclosure may be used in a borehole used for placement of utility lines. Accordingly, the terms "wellbore," "borehole" and the like should not be interpreted to limit tools, systems, assemblies, or methods of the present disclosure to any particular industry, field, or environment.

One or more specific embodiments of the present disclosure are described herein. These described embodiments are examples of the presently disclosed techniques. Additionally, in an effort to provide a concise description of these embodiments, not all features of an actual embodiment may be described in the specification. It should be appreciated that in the development of any such actual implementation, as in any engineering or design project, numerous embodiment-specific decisions will be made to achieve the developers' specific goals, such as compliance with system-related and business-related constraints, which may vary from one embodiment to another. Moreover, it should be appreciated that such a development effort might be complex and time consuming, but would nevertheless be a routine undertaking of design, fabrication, and manufacture for those of ordinary skill having the benefit of this disclosure.

The articles "a," "an," and "the" are intended to mean that there are one or more of the elements in the preceding descriptions. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

The present disclosure may be embodied in other specific forms without departing from its spirit or characteristics. The described embodiments are to be considered as illustrative and not restrictive. The scope of the disclosure is, therefore, indicated by the appended claims rather than by the foregoing description. Changes that come within the meaning and range of equivalency of the claims are to be embraced within their scope.

What is claimed is:

1. A downhole transducer assembly, comprising:

a housing including:

a main flow area;

a first chamber;

a second chamber downhole of the first chamber;

a first inlet through which a first diverted portion of fluid from the main flow area enters the first chamber; and an outlet through which the first diverted portion of fluid exits the first chamber;

a turbine rotatable within the first chamber with an angular velocity;

a generator, including a rotor within the generator being rotationally fixed to the turbine;

a valve downhole of the first inlet of the housing and movable to allow a second diverted portion of fluid from the main flow area into the second chamber;

an actuator powered by the generator and configured to open or close the valve;

a pathway from the first inlet to the valve separate from the main flow area and bypassing the turbine; and a surge protector in electrical connection with the generator, the surge protector configured to electrically connect the generator with the actuator to activate the valve and divert current of the generator to the actuator in response to a voltage or pressure spike, such that the angular velocity of the turbine is reduced.

2. The downhole transducer assembly of claim 1, wherein the surge protector is configured to reduce total voltage sustained by the generator.

3. The downhole transducer assembly of claim 1, the surge protector being a current limiter.

4. The downhole transducer assembly of claim 1, the surge protector being a voltage limiter.

5. The downhole transducer assembly of claim 1, the surge protector including a metal oxide varistor.

6. The downhole transducer assembly of claim 1, the surge protector including a gas discharge tube.

7. The downhole transducer assembly of claim 1, the surge protector including a transzorb or zener diode.

8. The downhole transducer assembly of claim 1, the housing including a second inlet downhole of the first inlet, the second inlet configured to allow the second diverted portion of fluid from the main flow area into the second chamber without traveling through a turbine chamber.

9. The downhole transducer assembly of claim 1, the second chamber being a second turbine chamber housing a second turbine.

10. The downhole transducer assembly of claim 1, the second chamber including a second generator therein.

11. The downhole transducer assembly of claim 1, the outlet fluidly coupling a turbine chamber to an exterior of the housing.

12. The downhole transducer assembly of claim 1, at least one of the first inlet and the outlet including a nozzle.

13. The downhole transducer assembly of claim 12, the nozzle controlling flow of the first diverted portion of fluid in a turbine chamber.

14. A method for regulating power generation of a downhole transducer assembly, the method comprising:

rotating a turbine with an angular velocity in relation to a fluid pressure differential, the turbine being within a turbine chamber receiving first diverted flow from a main flow area; and in response to a pressure spike, regulating the fluid pressure differential using a pressure regulator by actuating the pressure regulator through operation of an actuator to reduce the angular velocity of the turbine, wherein regulating the fluid pressure differential includes routing the first diverted flow from the turbine chamber to the pressure regulator through a pathway separate from the main flow area and bypassing the turbine;

wherein actuating the pressure regulator includes using a surge protector that is electrically connected to a generator to electrically connect the generator with the actuator to activate the pressure regulator and divert current of the generator to the actuator in response to the pressure spike.

15. The method of claim 14, wherein the pressure regulator regulates a fluid volumetric flow through an inlet to the pressure regulator.

16. The method of claim 14, wherein the surge protector reduces total voltage sustained by the generator.

17. The method of claim 14, wherein the surge protector directly monitors at least one of current or voltage of the generator.

18. The method of claim 14, wherein the pressure regulator comprises a valve.

19. The method of claim 18, wherein the valve is disposed downhole of the turbine.

* * * * *